US007232123B2

(12) United States Patent
Förch et al.

(10) Patent No.: US 7,232,123 B2
(45) Date of Patent: Jun. 19, 2007

(54) APPARATUS FOR CONVEYING SHEETS THROUGH A PRINTING MACHINE

(75) Inventors: Peter Förch, Neustadt (DE); Markus Möhringer, Weinheim (DE); Paul Nicola, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 255 days.

(21) Appl. No.: 10/950,342

(22) Filed: Sep. 24, 2004

(65) Prior Publication Data

US 2005/0087924 A1 Apr. 28, 2005

(30) Foreign Application Priority Data

Oct. 22, 2003 (DE) ..... 103 49 074

(51) Int. Cl.
*B65H 29/06* (2006.01)

(52) U.S. Cl. ..... 271/82; 271/204; 271/205; 271/85

(58) Field of Classification Search ..... 271/277, 271/4.06, 3.24, 82, 205, 85, 204; 101/408, 101/480; 294/116; 198/867.05, 867.07, 198/867.02, 867.06, 803.2, 476.1, 803.9, 198/803.7, 803.8, 803.3
See application file for complete search history.

(56) References Cited

U.S. PATENT DOCUMENTS

| | | | | |
|---|---|---|---|---|
| 2,418,065 | A * | 3/1947 | Bobst | 198/803.7 |
| 5,125,640 | A * | 6/1992 | Yerly et al. | 271/204 |
| 5,356,128 | A * | 10/1994 | Eberle et al. | 271/204 |
| 5,605,098 | A | 2/1997 | Wadlinger | |
| 5,758,576 | A | 6/1998 | Mack et al. | |
| 6,578,846 | B2 | 6/2003 | Maul et al. | |
| 6,612,569 | B2 | 9/2003 | Schaum | |
| 6,705,227 | B2 | 3/2004 | Becker | |
| 2002/0084581 | A1 * | 7/2002 | Schaum | 271/275 |

FOREIGN PATENT DOCUMENTS

| | | |
|---|---|---|
| DE | 345591 | 12/1921 |
| DE | 2 252 231 | 5/1974 |
| DE | 44 34 151 C2 | 3/1996 |
| DE | 195 27 439 A1 | 2/1997 |
| DE | 199 09 688 A1 | 12/1999 |
| DE | 100 14 417 A1 | 9/2001 |
| DE | 101 56 800 A1 | 7/2002 |
| DE | 102 35 895 A1 | 4/2003 |
| DE | 101 52 592 A1 | 5/2003 |
| GB | 209881 | 1/1924 |

* cited by examiner

*Primary Examiner*—Patrick Mackey
*Assistant Examiner*—Mark Hageman
(74) *Attorney, Agent, or Firm*—Laurence A. Greenberg; Werner H. Stemer; Ralph E. Locher

(57) ABSTRACT

An apparatus for conveying sheets from a printing machine to a stack has highly rigid gripper bars that can be produced with relatively little expense, and the gripper assembly permits great flexibility in the use of the apparatus. The apparatus has at least one gripper bar carrying one or more grippers which, during the conveyance, holds a sheet at its edge between a gripper finger and a gripper pad. Endless chains move the gripper bar on a path between a cylinder belonging to the machine and the stack. An actuating mechanism opens and closes the gripper as a sheet is picked up from the cylinder and as it is allowed to fall onto the stack. In the opened state, the gripper finger is located below a path described by the upper edge of the gripper pad.

9 Claims, 4 Drawing Sheets

APPARATUS FOR CONVEYING SHEETS THROUGH A PRINTING MACHINE

BACKGROUND OF THE INVENTION

Field of the Invention

The invention relates to an apparatus for conveying sheets through a printing machine and from the printing machine to a stack. The apparatus comprises at least one gripper bar, on which there is arranged at least one gripper which, during the conveyance, holds a sheet at its edge between a gripper finger and a gripper pad. Endless chains move the gripper bar on a path between a cylinder belonging to the machine and the stack. An actuating mechanism opens and closes the gripper as a sheet is picked up from the cylinder and as it is allowed to fall onto the stack.

In printing presses, it is known to deposit sheets on a stack by means of mechanical grippers. The grippers are arranged on gripper bars which are connected to endless chains, cylinders or other rotating elements. The sheets are held at the leading edge and/or trailing edge by the grippers as they are conveyed. The sheets are deposited on the stack by being allowed to fall out of the grippers, actuating devices opening the grippers. As the sheets fall down, blower and/or vacuum devices can act in an accelerative manner. The aim of the sheet deposition is to convey and deposit the sheets quickly and without impairing the quality. The gripper bars are therefore constructed in a flexurally and torsionally rigid manner.

German published patent application DE 195 27 439 A1 and its corresponding U.S. Pat. No. 5,758,576 describe a gripper bar for a delivery of a press, which is optimized with respect to weight, height, flexural and torsional rigidity. The gripper bar comprises a box-like hollow profile, into the interior of which a gripper shaft having gripper fingers is inserted. The gripper fingers project through apertures and interact with gripper pads which are located on the upper side of the hollow profile. The gripper tips are above the gripper pads in the opened and closed state. When the grippers are opened, the gripper tips lift off the gripper pads only to the extent necessary to accommodate a sheet with a maximum sheet thickness. In order to avoid a collision along the conveying section, the conveying elements which interact with the grippers, and other mechanical elements must have appropriate clearances, into which the gripper tips can dip as they move past. This constitutes additional expenditure on material and costs. As a result of the slight lifting of the gripper tips of the gripper pads, the result is virtually only one degree of freedom for releasing a sheet from the grippers. The area of application of such grippers is therefore restricted. In the printing unit according to German published patent application DE 101 56 800 A1 and corresponding U.S. Pat. No. 6,612,569, clamping jaws of a leading edge gripper system are mounted on an impression cylinder such that they can be pivoted by means of a gripper shaft. If the gripper system approaches an inkjet print head, then it is pivoted away below the peripheral contour of the impression cylinder in order to avoid a collision. The sheet supporting surface of the impression cylinder is used at the same time as a gripper pad. In interaction with a feed cylinder connected upstream, the clamping jaws dip into a channel in the feed cylinder. It is an object of the invention to develop an apparatus for conveying sheets through a printing machine which, with less expenditure and with high rigidity of gripper bars, permits high flexibility in the use of the apparatus.

SUMMARY OF THE INVENTION

It is accordingly an object of the invention to provide an apparatus for transporting sheets through a printing machine which overcomes the above-mentioned disadvantages of the heretofore-known devices and methods of this general type.

With the foregoing and other objects in view there is provided, in accordance with the invention, an apparatus for conveying sheets from a printing machine to a stack, comprising:

gripper bar carrying at least one gripper having a gripper finger and a gripper pad for holding a sheet at an edge thereof between the gripper finger and the gripper pad during a conveyance of the sheet;

an endless chain for moving the gripper bar on a path between a cylinder of the printing machine and the stack; and an actuating mechanism configured to close and open the gripper as a sheet is picked up from the cylinder and as the sheet is released at the stack;

the gripper pad defining an upper edge and the gripper finger lying below a path described by the upper edge of the gripper pad.

In accordance with an added feature of the invention, the gripper bar comprises a hollow profile and a gripper shaft rotatably disposed in an interior of the hollow profile to and fro within a rotational angle range, and a multiplicity of gripper fingers for holding the trailing edge of the sheet are affixed to the gripper shaft, and the gripper fingers each project through a respective opening formed in the hollow profile, wherein a width of the opening, in a direction of rotation of the gripper fingers is less than a range of movement of the gripper fingers in the rotational angle range.

In accordance with an additional feature of the invention, the gripper finger is an angled finger having a limb with an arcuate form in the rotational angle range.

In accordance with another feature of the invention, the gripper bar has a partly circular form in cross section, and the limb is matched to the form of the gripper bar.

In a particularly advantageous embodiment of the invention, in the opened position of the gripper, the limb of the gripper finger is disposed in an interior of the gripper bar.

In accordance with a further feature of the invention, the gripper bar is a drawn hollow profile.

In accordance with again an added feature of the invention, the opening is a clearance for a mounting tool for fixing the gripper finger to the gripper shaft.

In accordance with again an additional feature of the invention, the gripper fingers are elastically sprung.

In accordance with again another feature of the invention, the gripper shaft is a thin-walled tube.

In accordance with a concomitant feature of the invention, the at least one gripper is one of a plurality of grippers formed as trailing edge grippers.

In other words, the objects of the invention are achieved in that the grippers open with a large opening angle of, for example, 90 degrees, so that, when they are opened, the gripper fingers are located below a path described by the upper edges of the gripper fingers during conveyance. Therefore, as viewed in the conveying direction, the gripper tips are moved behind and beside the gripper pads as they open. After they have been opened, a sheet can be carried away perpendicular or parallel to the gripper pad.

When the apparatus is implemented in a press having trailing edge grippers and leading edge grippers in the delivery, there is provided the advantage that an adjacent cylinder conveying the sheet can be passed without collision by the trailing edge grippers. When the apparatus is used in the delivery of a press in order to reduce the speed and to deposit sheets by using trailing edge grippers, as a result of the wide opening of the grippers, there is the possibility of carrying a sheet away downward and in the direction opposite to the movement of the grippers. Threading the trailing edge of the sheet out of a gap between gripper tips and gripper pads is not necessary.

As a result of this construction of gripper bars and gripper shafts as hollow profiles, the apparatus has a low mass. During the deflection of the gripper bars, only small centrifugal forces arise, which can be absorbed without difficulty by chain guides. The gripper fingers are shaped in such a way that they project from the hollow profile of a gripper bar through small openings. As the grippers open, the gripper fingers are pulled back into the interior of the hollow profile through the openings. For this purpose, the gripper fingers and/or the hollow profile can be designed to be curved in cross section. The openings are so small that a high torsional and flexural rigidity is achieved. If required, a tool for fixing the gripper fingers to the gripper shaft can be led through the openings. The gripper bars can advantageously be composed of a drawn hollow profile of a lightweight material, in particular of an aluminum alloy. If the gripper fingers are provided with a high inherent elasticity, it is possible to dispense with separate springs.

Other features which are considered as characteristic for the invention are set forth in the appended claims.

Although the invention is illustrated and described herein as embodied in an apparatus for conveying sheets through a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
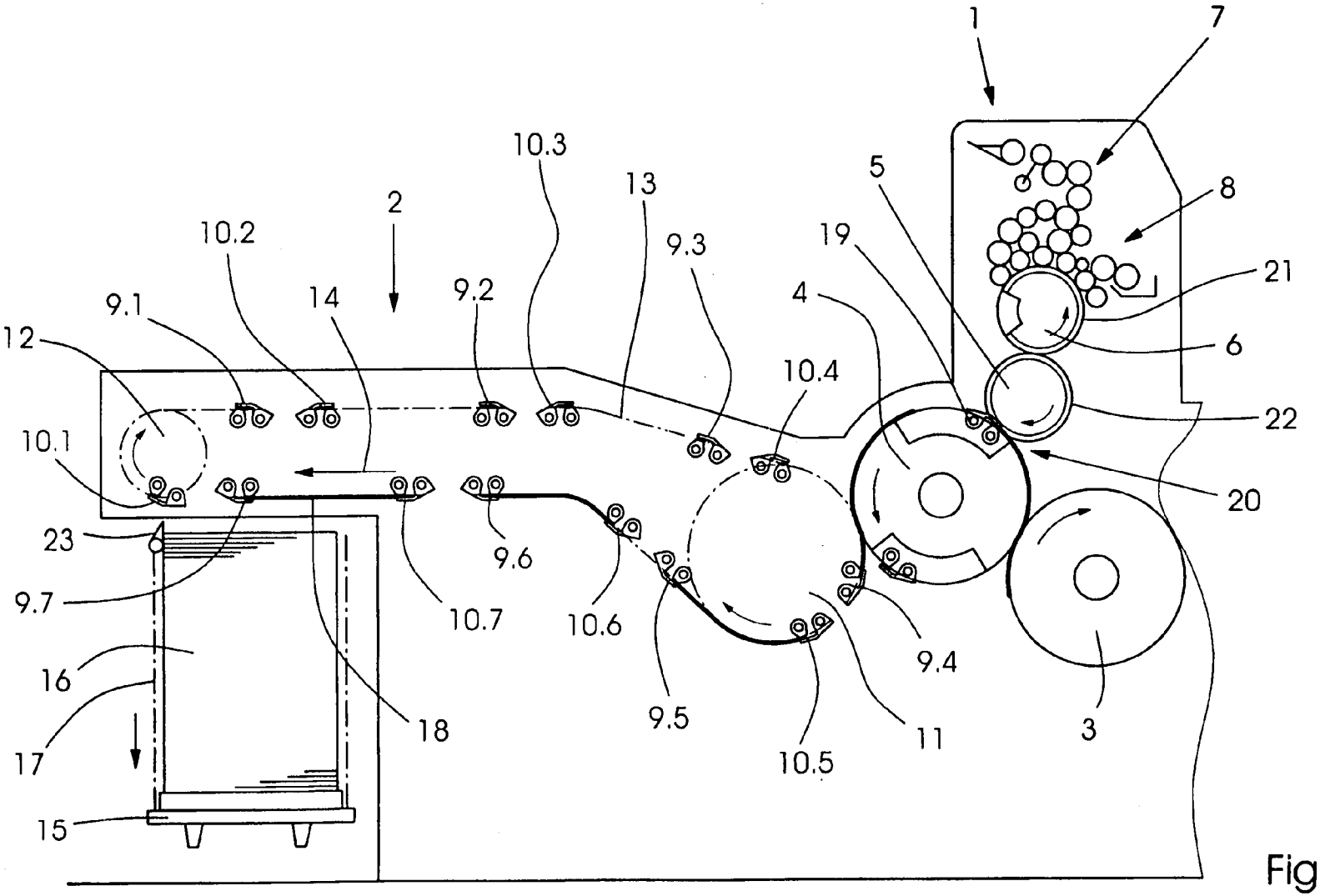
FIG. 1 is a diagrammatic side view of a delivery of a printing press having gripper bars.

Referring now to the figures of the drawing in detail and first, particularly, to FIG. 1 thereof, there is shown a last printing unit of a sheet-fed press having a delivery 2 arranged downstream. The printing unit 1 contains a sheet transport drum 3, an impression cylinder 4, a transfer cylinder 5 and a plate cylinder 6. The plate cylinder 6 is assigned rolls belonging to an inking unit 7 and a dampening unit 8. The delivery 2 comprises a chain gripper system having a large number, i.e., a multiplicity, of leading edge grippers 9.1 to 9.7 and trailing edge grippers 10.1 to 10.7, which are fixed to gripper bars. The gripper bars are connected to endless chains, which are placed over deflection drums 11, 12 and guided in chain tracks 13. In the conveying direction 14, at the end of the lower runs of the chain tracks 13, there is a stack table 15, on which there is a stack 16. The stack table 16 can be lowered by a chain mechanism 17 in accordance with the progress of production. The sheets 18 are conveyed from the preceding printing unit to the impression cylinder 4 by means of the sheet transport drum 3. On the impression cylinder 4, the sheets 18 are held in grippers 19 and are guided through a press nip 20 between the transfer cylinder 5 and the impression cylinder 4. By using the dampening unit 8 and the inking unit 7, a printing form 21 clamped on the plate cylinder 6 is inked in accordance with an image. The transfer cylinder 5 has a resilient cover 22, with which the printing ink is transferred to the sheet 18 in the press nip 20. In the delivery 2, the sheets 18 are picked up at the leading edge by the leading edge grippers 9, the trailing edge of the sheets 18 being held by the trailing edge grippers 10. Shortly before the stack 16, the grippers 9, 10 are opened, so that a sheet 18 falls onto the stack 16. A leading edge stop 23 limits the movement in the conveying direction 14 of the sheet 18 allowed to fall.

Figure 2:
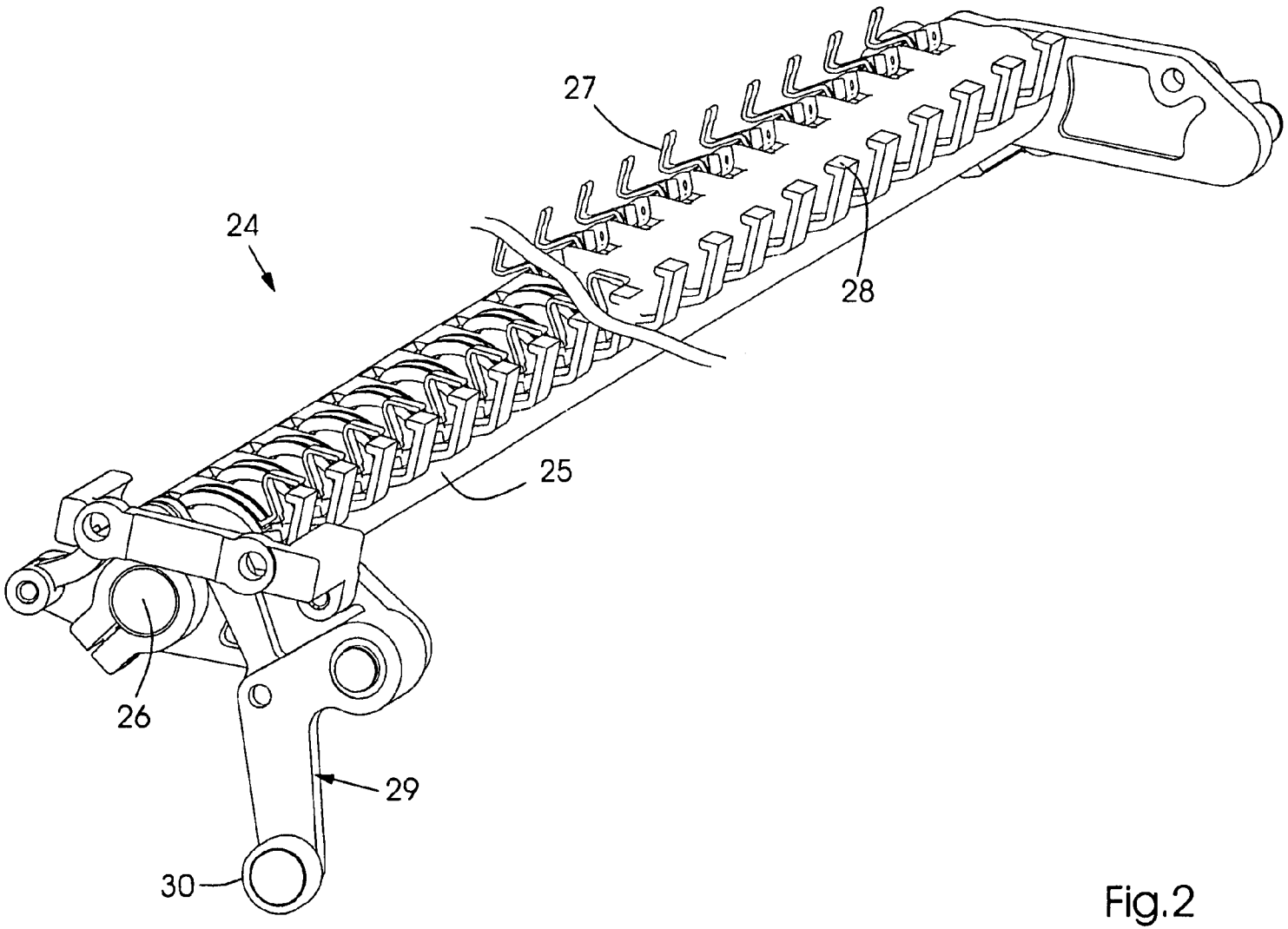
FIG. 2 is a perspective view of a trailing edge gripper bar with a large number of grippers.

FIG. 2 shows one of the gripper bars 24 for the trailing edge grippers 10 in a perspective illustration. Each gripper bar 24 comprises a hollow profile 25, in the interior of which a gripper shaft 26 is mounted. The gripper shaft 26 bears a large number of gripper fingers 27, each of which is assigned a gripper pad 28. The gripper pads 28 are machined out of the hollow profile 25. The gripper fingers 27 are arranged such that they can be moved together by means of rotation of the gripper shaft 26. In FIG. 2 the gripper fingers 27 are illustrated in the closed and opened position. In order to actuate the gripper shaft 26, a lever mechanism 29 having a cam roller 30 is provided. The cam roller 30 interacts with cam tracks arranged in a fixed position in the delivery.

Figure 3:
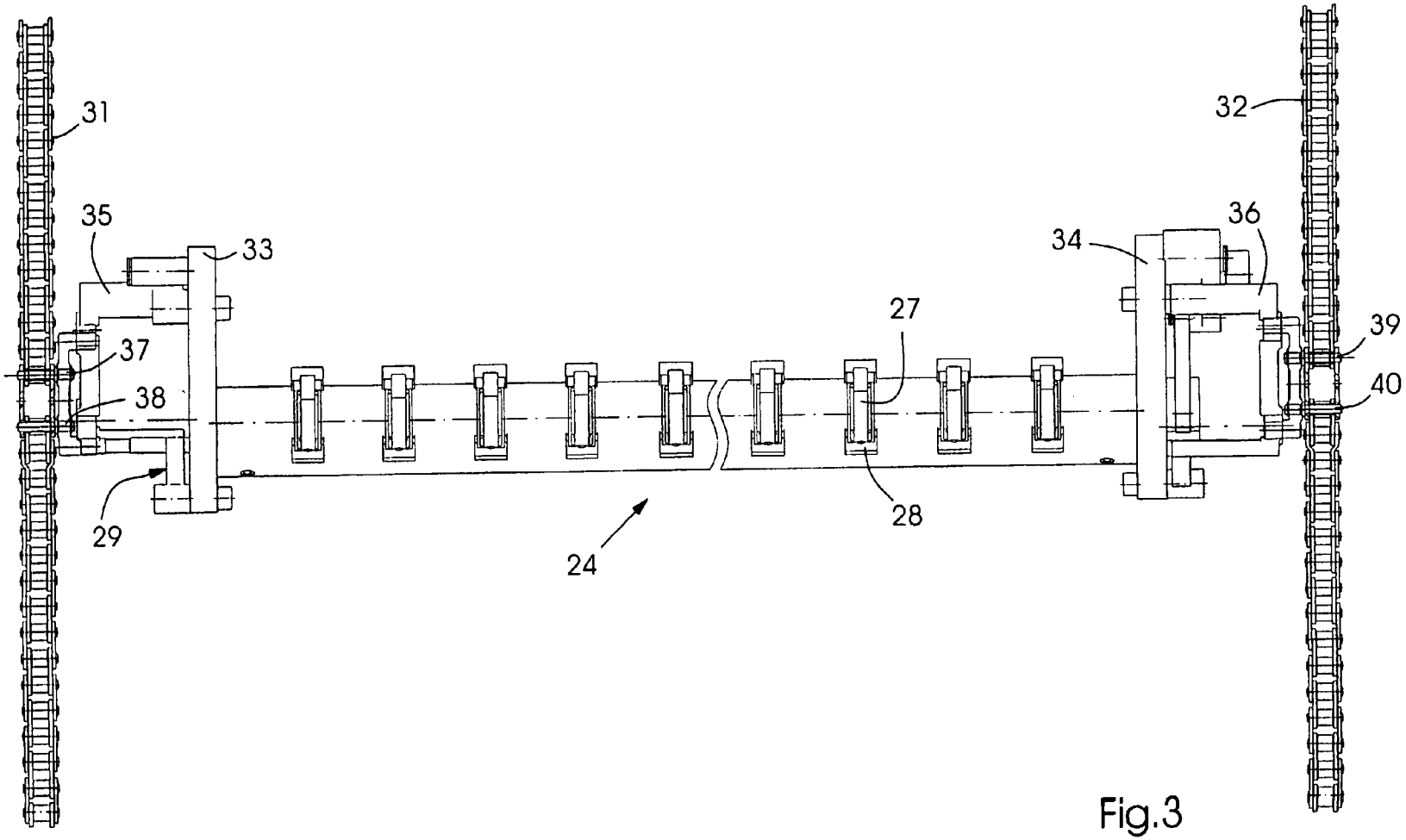
FIG. 3 is a plan view showing an attachment of a gripper bar to its transport chains.

FIG. 3 shows the attachment of the gripper bar 24 to chains 31, 32, which are guided in the chain tracks 13. The gripper bar 24 is held between holding plates 33, 34. Fixed to the holding plates 33, 34 are coupling elements 35, 36, in which chain pins 37 to 40 engage in each case.

Figure 4:
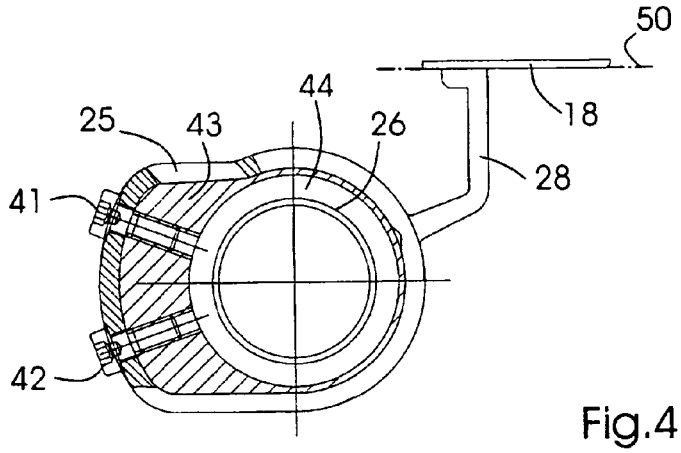
FIG. 4 is a sectional view taken through a trailing edge gripper bar outside the region of a gripper finger.
Figure 5:
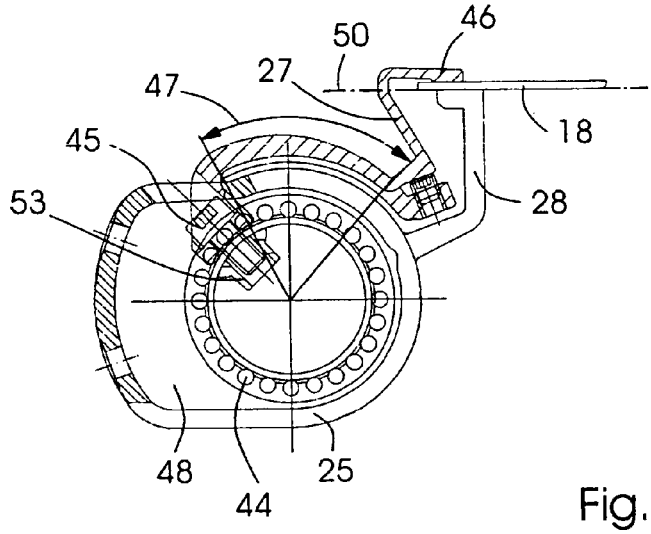
FIG. 5 is a sectional view taken through a trailing edge gripper bar in the region of a gripper finger in the closed position of the grippers.
Figure 6:
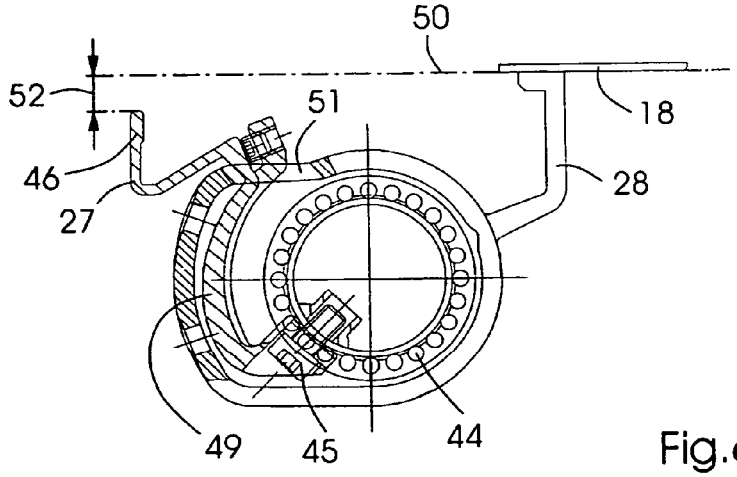
FIG. 6 is a similar view showing the gripper in the open position.

FIGS. 4 to 6 show sectional illustrations through the gripper bar 24. According to FIG. 4, the section runs between two gripper pads 28. By using screws 41, 42, a bearing web 43 for holding an antifriction bearing 44 is fixed in the hollow profile 25. The gripper shaft 26 is formed as a thin-walled tube and is held in the inner ring of the antifriction bearing 44.

In FIGS. 5 and 6, the section is taken through a gripper finger 27. The spring-loaded gripper finger 27 is fixed to the gripper shaft 26 by a screw 45. The gripper finger 27 is formed with an angled-over portion, so that the gripper tip 46 is seated flat on the gripper pad 28 when it is in the closed state. The gripper finger 27 is arcuate over the rotational angle range 47 of the gripper shaft 26. The curvature of the gripper finger 27 is matched to the external contour of the hollow profile 25. In the hollow profile 25 there is a clearance 48, into which the arcuate limb 49 dips when in the opened state, as can be seen from FIG. 6. As the gripper bars 24 move along the chain tracks 13, the upper edge of the gripper pad 28 runs along a path 50 shown dash-dotted. As it opens, the gripper finger 27 is pulled back into the interior of the hollow profile through an opening 51, the gripper tip

46 being located at a distance 52 under the path 50. There therefore exist a series of degrees of freedom for leading a sheet 18 away from the gripper pad 28. Furthermore, in the opened state, there is no risk of any collision between the gripper tips and components in the vicinity of the path 50. In the closed state, the opening 51 permits access to the screw 45 which, in order to fix the gripper finger 27, is screwed into a strip 53 which is located in the interior of the gripper shaft 26.

This application claims the priority, under 35 U.S.C. § 119, of German patent application No. 103 49 074.4, filed Oct. 22, 2003; the entire disclosure of the prior application is herewith incorporated by reference.

We claim:

1. An apparatus for conveying sheets from a printing machine to a stack, comprising:

gripper bar carrying at least one gripper having a gripper finger and a gripper pad for holding a sheet at an edge thereof between said gripper finger and said gripper pad during a conveyance of the sheet;

an endless chain for moving said gripper bar on a path between a cylinder of the printing machine and the stack; and an actuating mechanism configured to close and open said gripper as a sheet is picked up from the cylinder and as the sheet is released at the stack;

in an open state of said gripper, said gripper pad defining an upper edge and said gripper finger lying below a path described by said upper edge of said gripper pad;

said gripper bar having a hollow profile and a gripper shaft rotatably disposed in an interior of said hollow profile and being rotational to and fro within a angle range, a multiplicity of gripper fingers for holding the trailing edge of the sheet being affixed to said gripper shaft, and said gripper fingers each projecting through a respective opening formed in said hollow profile, said opening having a width, in a direction of rotation of said gripper fingers, being less than a range of movement of said gripper fingers in the rotational angle range.

2. The apparatus according to claim 1, wherein said gripper finger is an angled finger having a limb with an arcuate form in the rotational angle range.

3. The apparatus according to claim 2, wherein said gripper bar has an external contour in cross section, and said limb is matched to said external contour of said gripper bar.

4. The apparatus according to claim 2, wherein, in the opened position, said limb of said gripper finger is disposed in an interior of said gripper bar.

5. The apparatus according to claim 1, wherein said gripper bar is formed of a drawn hollow profile.

6. The apparatus according to claim 1, wherein said opening is a clearance for a mounting tool for fixing said gripper finger to said gripper shaft.

7. The apparatus according to claim 1, wherein said gripper fingers are elastically sprung.

8. The apparatus according to claim 1, wherein said gripper shaft is a thin-walled tube.

9. The apparatus according to claim 1, wherein said at least one gripper is one of a plurality of grippers formed as trailing edge grippers.

* * * * *